US006496588B1

(12) United States Patent
Chang

(10) Patent No.: US 6,496,588 B1
(45) Date of Patent: Dec. 17, 2002

(54) DIRECTIONAL DYNAMIC MICROPHONE INTERCHANGEABLE TO HAVE UNIDIRECTIONAL AND SUPERDIRECTIONAL CHARACTERISTICS

(76) Inventor: Ching-Lu Chang, No. 39, Lane 29, Shih-Chia Rd., Tung Dist., Taichung City (TW)

( * ) Notice: Subject to any disclaimer, the term of this patent is extended or adjusted under 35 U.S.C. 154(b) by 0 days.

(21) Appl. No.: 09/266,355

(22) Filed: Mar. 11, 1999

(51) Int. Cl.[7] ..... H04R 25/00
(52) U.S. Cl. ..... 381/358; 381/356
(58) Field of Search ..... 381/355–358, 381/387, FOR 142, 147

(56) References Cited

U.S. PATENT DOCUMENTS

| | | | | | |
|---|---|---|---|---|---|
| 967,217 | A | * | 8/1910 | Mattison | 381/355 |
| 2,739,659 | A | * | 3/1956 | Daniels | 381/338 |
| 4,401,859 | A | * | 8/1983 | Watson | 181/158 |
| 4,410,770 | A | * | 10/1983 | Hagey | 181/151 |
| 4,685,137 | A | * | 8/1987 | Watson et al. | 381/174 |
| 5,781,644 | A | * | 7/1998 | Chang | 381/355 |
| 6,091,828 | A | * | 7/2000 | Akino et al. | 381/170 |

* cited by examiner

*Primary Examiner*—Curtis Kuntz
*Assistant Examiner*—P. Dabney
(74) *Attorney, Agent, or Firm*—Harness, Dickey & Pierce, P.L.C.

(57) ABSTRACT

A directional dynamic microphone includes a protective cover, a diaphragm in air-tight engagement with the cover, a voice coil, and a magnet with a core pole member and a tubular pole member and disposed rearwardly of the diaphragm. The magnet has an outer front circumferential portion which is spaced apart from an annular wall of the cover to confine a sound passage therebetween, an outer intermediate circumferential portion which engages the annular wall and which defines a sound port opening outwardly and radially for air communication with the sound passage, and an outer rear circumferential portion with sound holes angularly displaced therein and smaller than the sound port. Each sound hole extends inwardly and radially for air communication with a rear major side of the diaphragm. A phase shift effecting sheet veils the sound port so as to impart the microphone with a unidirectional characteristic. A cylindrical shield member is sleeved on and is retainingly slidable relative to the outer rear circumferential portion, and has through holes. When the through holes are not registered with the sound holes to deny entry of a sound wave into the sound holes, the microphone is unidirectional. When the through holes are registered with the sound holes to admit the sound wave thereinto, the microphone is superdirectional.

1 Claim, 5 Drawing Sheets

DIRECTIONAL DYNAMIC MICROPHONE INTERCHANGEABLE TO HAVE UNIDIRECTIONAL AND SUPERDIRECTIONAL CHARACTERISTICS

BACKGROUND OF THE INVENTION

1. Field of the Invention

This invention relates to a directional dynamic microphone, more particularly to a directional dynamic microphone which is interchangeable to have unidirectional and superdirectional characteristics.

2. Description of the Related Art

Referring to FIG. 1, a conventional directional dynamic microphone is shown to include a main body 4 with a magnet 401 and an iron yoke 402, a washer 5, a plastic outer ring 6 with a connecting plate 601, a rear cap 7 with through holes 702 formed therearound, a voice coil 2, a diaphragm 3, a protective cover 1, and a housing 8. A felt piece 703, a washer 704 and screw rod 705 are disposed between the rear cap 7 and the housing 8. A sound pressure regulating rod 9 passes through a through hole 802 in the housing 8 and extends forwardly to engage threadedly the screw rod 705 for securing the housing 8 to the rear cap 7.

By virtue of the through holes 702, the conventional microphone has a unidirectional characteristic. It is desirable for the microphone to have unidirectional and superdirectional characteristics so as to be adapted for use in different application.

SUMMARY OF THE INVENTION

The object of the present invention is to provide a directional dynamic microphone which is interchangeable to have unidirectional and superdirectional characteristics.

According to this invention, the directional dynamic microphone includes a protective cover with a front air-permeable major wall and a rear air-impermeable annular wall extending rearwardly from a periphery of the front air-permeable major wall around an axial direction. A diaphragm is in air-tight engagement with an inner proximate annular portion of the annular wall. A voice coil has a front looped section which is secured to a rear major side of the diaphragm, a rear looped section which is movable with the diaphragm in the axial direction, and two terminal ends adapted to be led out for transmission of an electrical signal. A magnet is disposed rearwardly of the diaphragm, and includes a core pole member and a tubular pole member of a polar nature opposite to that of the core pole member. The tubular pole member has a cylindrical portion which is spaced apart from the core pole member in radial directions such that an annular clearance is formed therebetween to accommodate the movement of the rear looped section so as to result in the electrical signal that is to be led out by the terminal ends.

An outer circumferential wall of the magnet includes an outer front circumferential portion which is spaced apart from an inner distal annular portion of the annular wall in the radial directions to confine a sound passage therebetween, an outer rear circumferential portion distal to the inner distal annular portion, and an outer intermediate circumferential portion between the outer front and rear circumferential portions. The outer intermediate circumferential portion engages the inner distal annular portion, and has a sound port that opens outwardly and radially for air communication with the sound passage. The outer rear circumferential portion has a plurality of sound holes which are angularly displaced therein around the axial direction. Each sound hole is of a dimension smaller than that of the sound port, and extends inwardly and radially for air communication with the rear major side of the diaphragm. A phase shift effecting sheet is made of a flexible material, and veils the sound port so as to impart the dynamic microphone with a unidirectional characteristic. By virtue of the sound holes, the dynamic microphone is superdirectional. A cylindrical shield member is sleeved on and is retainingly slidable relative to the outer rear circumferential portion around the axial direction, and has a plurality of through holes which are angularly displaced therein around the axial direction. As such, when the cylindrical shield member slides angularly relative to the outer rear circumferential portion to a unidirectional position, each through hole is not registered with a corresponding sound hole so that a sound wave is denied entrance into the sound holes to maintain the unidirectional characteristic of the dynamic microphone. When the cylindrical shield member moves to a superdirectional position, each through hole is registered with the corresponding sound hole so as to admit the sound wave thereinto and impart the dynamic microphone with the superdirectional characteristic.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
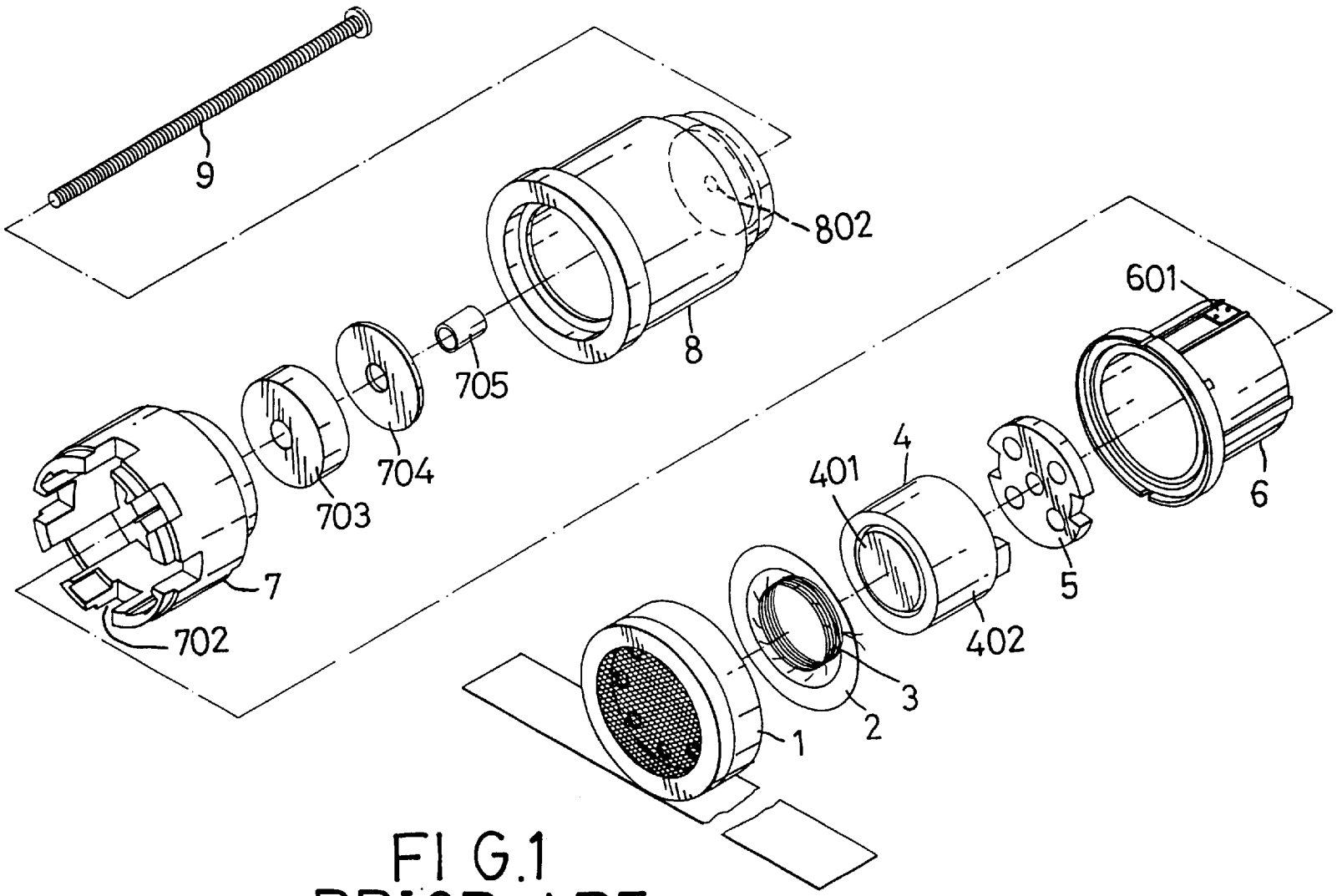
FIG.1 PRIOR ART
FIG. 1 is an exploded view of a conventional microphone.
Figure 2:
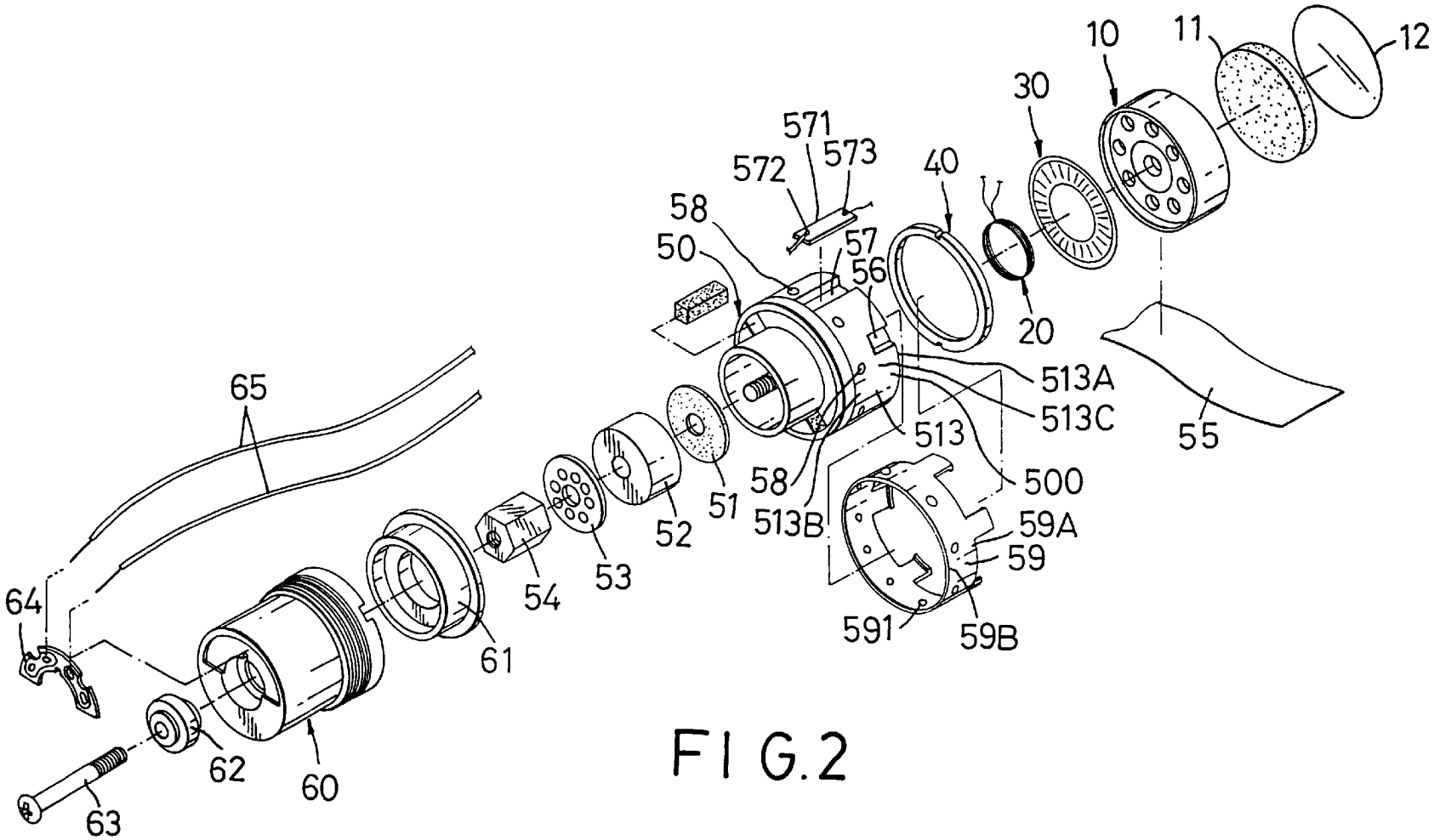
FIG. 2 is an exploded view of a preferred embodiment of a directional dynamic microphone according to this invention.
Figure 3:
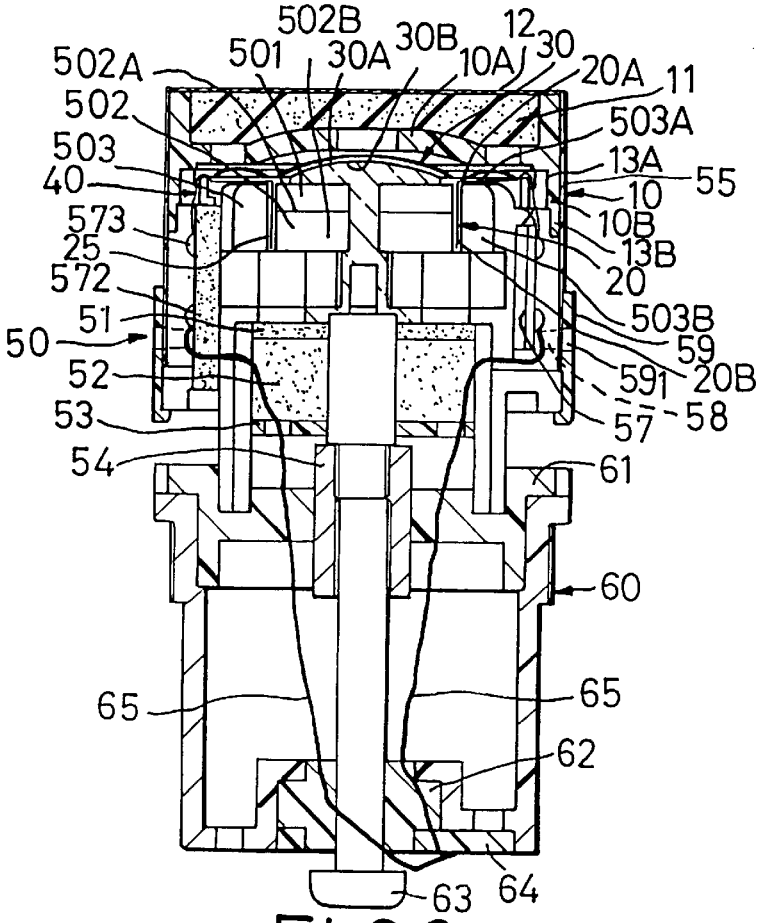
FIG. 3 is a sectional view of the preferred embodiment.

Referring to FIGS. 2 and 3, the preferred embodiment of the directional dynamic microphone according to the present invention is shown to comprise a protective cover 10, a diaphragm 30, a voice coil 20, a magnet 50, and an air chamber unit 60.

The protective cover 10 includes a front air-permeable major wall 10A for admitting entrance of an incident sound pressure, and a rear air-impermeable annular wall 10B which extends rearwardly from a periphery of the front air-permeable major wall 10A around an axial direction. The rear air-impermeable annular wall 10B has an inner proximate annular portion 13A relative to the front air-permeable major wall 10A, and an inner distal annular portion 13B. A sponge 11 and a nylon cloth 12 are disposed on the front air-permeable major wall 10A.

The diaphragm 30 is mounted on and is in air-tight engagement with the inner proximate annular portion 13A at a periphery thereof by means of a diaphragm seat 40. The diaphragm 30 has a front major side 30A proximate to the front air-permeable major wall 10A, and a rear major side 30B opposite to the front major side 30A in the axial direction.

The voice coil 20 has a front looped section 20A which is secured to the rear major side 30B, and a rear looped section 20B opposite to the front looped section 20A, and is movable with the diaphragm 30 in the axial direction. The voice coil 20 further has two terminal ends 20C adapted to be led out for transmission of an electrical signal.

The magnet 50 has a main body 500 which is disposed to be spaced apart from and which is rearwardly of the diaphragm 30 in the axial direction. A washer 501, a core pole member 502, and a tubular pole member 503 are mounted in the main body 500. The core pole member 502 has a front pole portion 502A with a periphery which is disposed to be transverse to the axial direction, and which is spaced apart from the rear major side 30B by the washer 501 so as to oppose the rear major side 30B, and a column portion 502B which extends from the periphery rearwards in the axial direction. The tubular pole member 503 has a polar nature opposite to that of the core pole member 502, and includes a front annular portion 503A which opposes spacedly the rear major side 30B, and a cylindrical portion 503B which is integrally formed with and which extends rearwards from the front annular portion 503A in the axial direction. The cylindrical portion 503B is spaced apart from the column portion 502B in radial directions such that an annular clearance 25 is formed therebetween to accommodate the movement of the rear looped section 20B of the voice coil 20, which, in response to the magnitude of the sound pressure incident on the diaphragm 30, results in the electrical signal that is to be led out by the terminal ends 20C. The main body 500 has an outer circumferential wall 513 distal to the column portion 502B in the radial directions. The outer circumferential wall 513 includes an outer front circumferential portion 513A. which is proximate to and which is spaced apart from the inner distal annular portion 13B in the radial directions so as to confine a sound passage therebetween. An outer intermediate circumferential portion 513C extends rearwardly of the outer front circumferential portion 513A, and engages the inner distal annular portion 13B. A plurality of through holes 56 are formed angularly in the outer intermediate circumferential portion 513C, and are air communicated with the sound passage to serve as a sound port 55A which opens outwardly and radially. Two receiving grooves 57 are formed angularly in the outer circumferential wall 513 for receiving two front coil connecting plates 571 therein. The front coil connecting plates 571 have front connecting ends 573 which are connected to the terminal ends 20C of the voice coil 20, and rear connecting ends 572 which are connected to a rear coil connecting plate 64 via two wires 65.

A phase shift effecting sheet 55 is made of a flexible material, and is disposed to veil the sound port 55A so as to impart the dynamic microphone with a unidirectional characteristic.

The outer circumferential wall 513 further includes an outer rear circumferential portion 513B distal to the inner distal annular portion 13B. The outer rear circumferential portion 513B defines a plurality of sound holes 58 which are angularly displaced therein around the axial direction. Each sound hole 58 is of a dimension smaller than that of the sound port 55A, and extends inwardly and radially to a position that is in air communication with the rear major side 30B.

Figure 4:
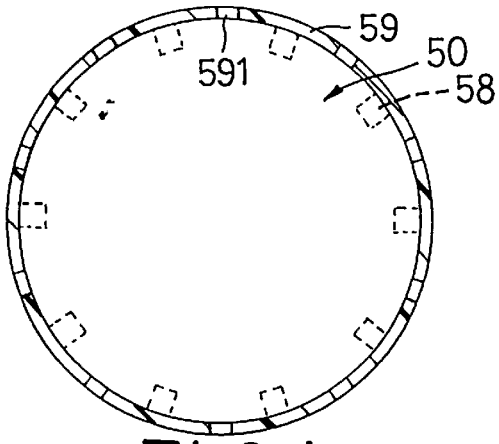
FIG. 4 is a partial cross-sectional view showing a cylindrical shield member in a unidirectional position.

A cylindrical shield member 59 is sleeved on and is retainingly slidable relative to the outer rear circumferential portion 513B around the axial direction. The cylindrical shield member 59 includes a front annular shield portion 59A which is proximate to the inner distal annular portion 13B, and a rear annular shield portion 59B which is integrally formed with and which extends rearwardly from the front annular shield portion 59A. The rear annular shield portion 59B has a plurality of through holes 591 which are angularly displaced therein around the axial direction. As such, when the cylindrical shield member 59 slides angularly relative to the outer rear circumferential. portion 513B to a unidirectional position, each through hole 591 is not registered with a corresponding sound hole 58 so that a sound wave is denied entrance into the sound holes 58, as shown in FIG. 4. When the cylindrical shield member 59 moves to a superdirectional position, each through hole 591 is registered with the corresponding sound hole 58 so as to admit the sound wave thereinto.

A sponge 51, a felt piece 52, a sound regulating plate 53, and a screw rod 54 are mounted in the main body 500 rearwardly of the outer rear circumferential portion 513B. A housing 60 has front and rear shockmount members 61,62 disposed at front and rear ends thereof, and is secured to the main body 500 in such a manner that a sound pressure regulating rod 63 engages threadedly the screw rod 54. The constructions of these components are similar to those of a conventional microphone and will not be detailed further.

Figure 5:
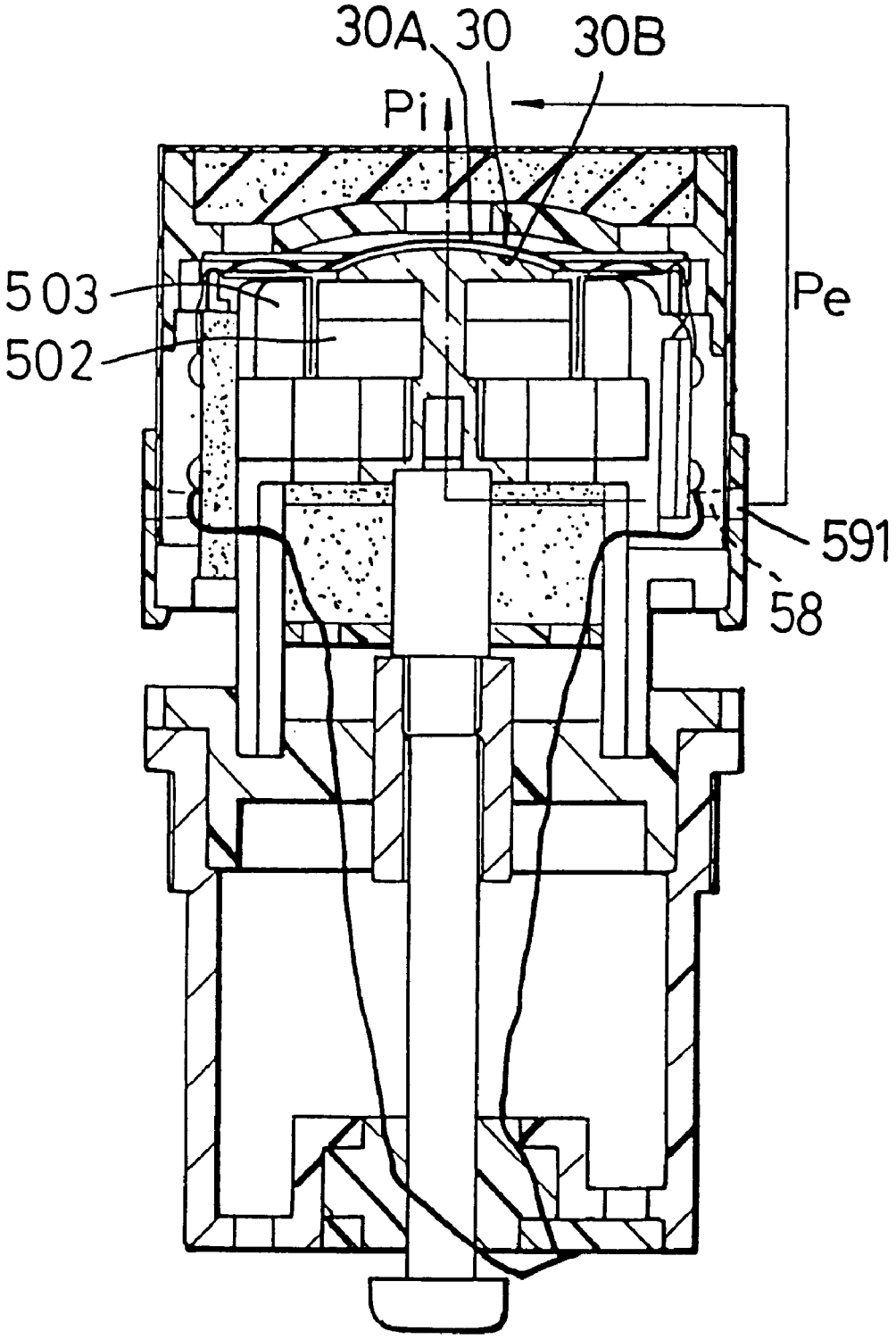
FIG. 5 is a sectional view similar to FIG. 3 but showing the path of the sound pressures in use.
Figure 6:
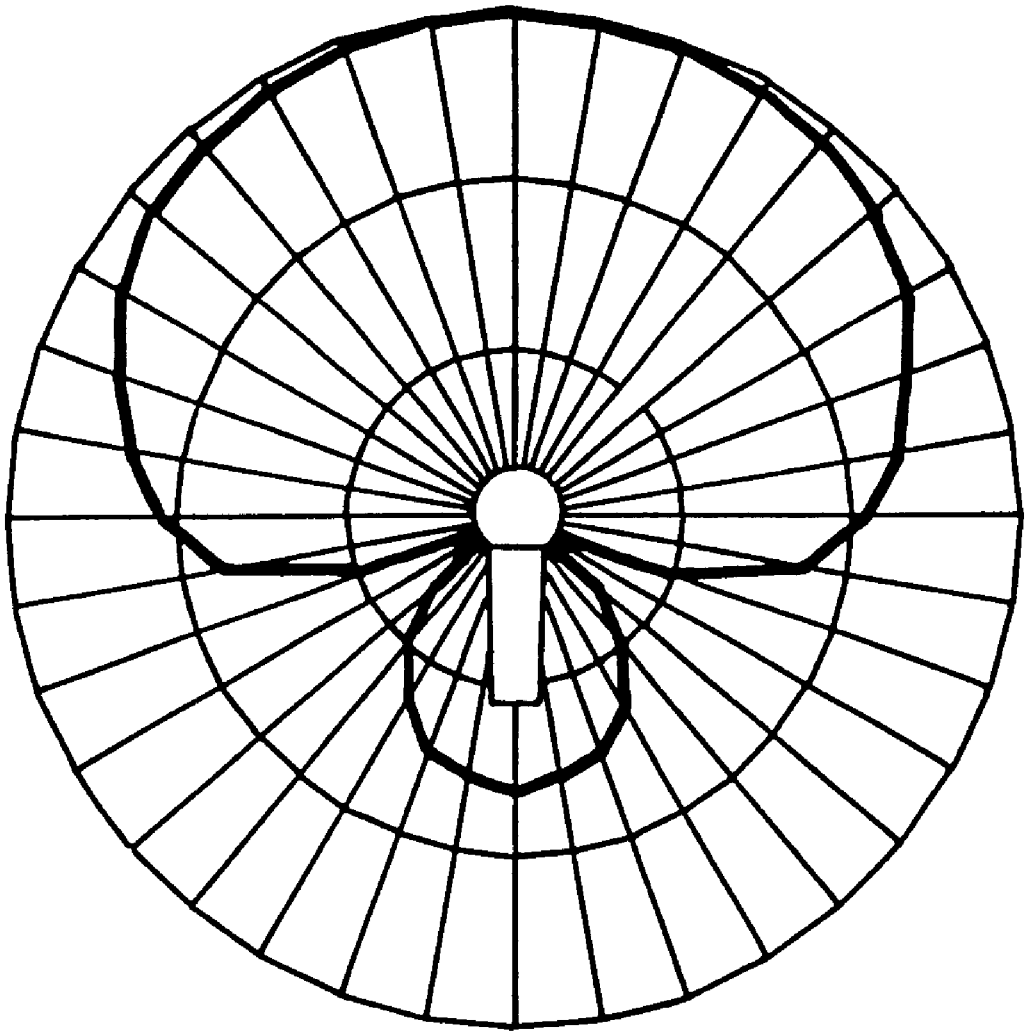
FIG. 6 is a schematic view showing a superdirectional pattern of the preferred embodiment.

As illustrated, referring to FIGS. 3, 5 and 6, when the cylindrical shield member 59 is moved to the superdirectional position, i.e. the through holes 591 are registered correspondingly with the sound holes 58, incident sound pressure is admitted in the dynamic microphone, and sound waves actuate the diaphragm 30. At this time, there are two paths of sound pressure acting upon the dynamic microphone. Pressure is forced upon the front major side 30A of the diaphragm 30, and causes a first sound pressure (Pe) via the magnet 50. Pressure is further admitted to the magnet 50 via the through holes 591 and the sound holes 58 to act upon the rear major side 30B via the magnet 50 to cause a second sound pressure (Pi), thereby effecting the phase shift of the microphone so as to impart the same with a superdirectional characteristic.

When the through holes 591 are not registered with the sound holes 58 such that a sound wave is denied entrance into the sound holes 58, the dynamic microphone is unidirectional by virtue of the sound port 55A.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A directional dynamic microphone which is interchangeable to have unidirectional and superdirectional characteristics, comprising:

a protective cover including a front air-permeable major wall with a periphery adapted to admit entrance of an incident sound pressure, and a rear air-impermeable annular wall extending rearwardly from said periphery and around an axial direction, said rear air-impermeable annular wall having an inner proximate annular portion relative to said front air-permeable major wall, and an inner distal annular portion;

a diaphragm with a periphery mounted on and in air-tight engagement with said inner proximate annular portion, and having a front major side proximate to said front air-permeable major wall, and a rear major side opposite to said front major side in said axial direction;

a voice coil having a front looped section secured to said rear major side, and a rear looped section opposite to said front looped section and movable with said diaphragm in said axial direction, said voice coil further having two terminal ends adapted to be led out for transmission of an electrical signal;

a magnet disposed to be spaced apart from, and rearwardly of said diaphragm in said axial direction, and including a core pole member having a front pole portion with a periphery disposed to be transverse to said axial direction, and spacedly opposing said rear major side, and a column portion extending from said periphery rearwards and in said axial direction; and a tubular pole member of a polar nature opposite to that of said core pole member, said tubular pole member including a front annular portion spacedly opposing said rear major side, and a cylindrical portion integrally formed with and extending rearwards from said front annular portion in said axial direction, said cylindrical portion being spaced apart from said column portion in radial directions such that an annular clearance is formed therebetween to accommodate the movement of said rear looped section which, in response to the magnitude of the sound pressure incident on said diaphragm, results in the electrical signal that is to be led out by said terminal ends, said magnet having an outer circumferential wall distal to said column portion in said radial directions, said outer circumferential wall including an outer front circumferential portion which is proximate to and which is spaced apart from said inner distal annular portion in said radial directions to confine a sound passage therebetween, an outer rear circumferential portion distal to said inner distal annular portion, and an outer intermediate circumferential portion interposed between the outer front and rear circumferential portions, said outer intermediate circumferential portion engaging said inner distal annular portion and defining a sound port which is in air communication with said sound passage, which opens outwardly and radially, and which is of a first dimension, said outer rear circumferential portion defining a plurality of sound holes which are angularly displaced therein around said axial direction, each of said sound holes being of a second dimension smaller than said first dimension, and extending inwardly and radially to a position which is in air communication with said rear major side;

a phase shift effecting sheet made of a flexible material, and disposed to veil said sound port so as to impart said dynamic microphone with the unidirectional characteristic; and a cylindrical shield member disposed to be sleeved on and retainingly slidable relative to said outer rear circumferential portion around said axial direction, said cylindrical shield member including a front annular shield portion which is proximate to said inner distal annular portion, and a rear annular shield portion integrally formed with and extending rearwardly from said front annular shield portion, said rear annular shield portion defining a plurality of through holes which are angularly displaced therein around said axial direction such that when said cylindrical shield member slides angularly relative to said outer rear circumferential portion to a unidirectional position, each of said through holes is not registered with a corresponding one of said sound holes so that a sound wave is denied entrance into said sound holes to maintain the unidirectional characteristic of said dynamic microphone, and when said cylindrical shield member moves to a superdirectional position, each of said through holes is registered with said corresponding one of said sound holes so as to admit the sound wave thereinto and impart said dynamic microphone with the superdirectional characteristic.

* * * * *